175-40 SR
12/20/83 XR 4,421,173

United States Patent [19]
Beakley et al.
[11] 4,421,173
[45] Dec. 20, 1983

[54] MOTION COMPENSATOR WITH IMPROVED POSITION INDICATOR

[75] Inventors: Bruce E. Beakley, Webster; Douglas W. J. Nayler, Kingwood, both of Tex.

[73] Assignee: NL Industries, Inc., New York, N.Y.

[21] Appl. No.: 294,436

[22] Filed: Aug. 20, 1981

[51] Int. Cl.[3] ..... E21B 19/09; E21B 7/12; E21B 43/013

[52] U.S. Cl. ..... 166/336; 166/355; 175/5; 175/9; 175/40; 254/277

[58] Field of Search ..... 33/DIG. 15; 91/1; 92/5 R; 166/336, 355; 175/5, 7, 8, 9, 27, 40; 254/277, 900; 340/618, 623, 624

[56] References Cited

U.S. PATENT DOCUMENTS

| | | | |
|---|---|---|---|
| 2,826,165 | 3/1958 | Adelson | 91/1 |
| 3,804,183 | 4/1974 | Duncan et al. | 175/5 |
| 3,881,695 | 5/1975 | Joubert | 175/5 |
| 3,946,559 | 3/1976 | Stevenson | 254/900 |
| 4,004,532 | 1/1977 | Reynolds | 254/277 |
| 4,121,806 | 8/1978 | Iato et al. | 175/27 |
| 4,176,722 | 12/1979 | Wetmore et al. | 166/355 |

FOREIGN PATENT DOCUMENTS

| | | | |
|---|---|---|---|
| 48102 | 2/1981 | United Kingdom | 254/900 |

OTHER PUBLICATIONS

"Electronic Differential Pressure Transmitter", Fisher and Porter Technical Specification 50DPF100-2-A/B/C.

*Primary Examiner*—Stephen J. Novosad
*Assistant Examiner*—William P. Neuder
*Attorney, Agent, or Firm*—Browning, Bushman, Zamecki & Anderson

[57] ABSTRACT

A motion compensator for disposition between an offshore support and an offshore well string or the like movable with respect to the support comprises first and second compensator bodies interconnected with the support and the well string such that relative movement between the support and well string causes relative movement between the compensator bodies. The compensator bodies are further interconnected with each other for relative movement in generally vertical directional modes. A compressible fluid or the like is associated with the compensator bodies for resiliently resisting relative movement therebetween in a first directional mode. A position indicator associated with the compensator bodies comprises a flexible vessel having one end connected to one of the compensator bodies and the other end connected to the other compensator body generally below the one end. The vessel is filled with a liquid between its two ends, and a pressure sensitive transmitter is associated with the lower end and operative to produce a signal which is a function of the hydraulic head at said lower end.

13 Claims, 6 Drawing Figures

MOTION COMPENSATOR WITH IMPROVED POSITION INDICATOR

BACKGROUND OF THE INVENTION

The present invention pertains to motion compensators used in connection with offshore drilling and production operations. One type of motion compensator is commonly referred to as a "drill string compensator." Typical drill string compensators are described in U.S. Pat. Nos. 3,877,680 and 3,804,183. Another type of motion compensator is commonly referred to as a "riser tensioner," and examples of such devices are described in U.S. Pat. Nos. 3,908,963 and 3,314,657.

Drill string compensators, riser tensioners, and other types of offshore motion compensators have certain features in common. Perhaps the most basic of these is the fact that, in any such compensator, there are two bodies interconnected for relative movement, usually telescopic movement, in generally vertical directional modes. These bodies may, for example, be a piston and cylinder. One of the bodies, usually the piston or its attached piston rod, is connected to an offshore well structure such as a drill string or a string of riser pipes, while the other is connected to an offshore support structure, such as drilling platform or vessel. The well structure and support structure are, of course, movable with respect to each other. Such movements will result in corresponding movement between the two compensator bodies. Some means is associated with the two compensator bodies for resiliently resisting relative movement therebetween in a first directional mode. This means may typically be a compressible fluid, usually a gas, interposed between the piston and one end of the cylinder.

It is conventional practice to associate with each such motion compensator a position indicator which provides the operator with an indication of the relative positions of the compensator bodies whereby the movements therebetween can be observed and/or recorded. In this manner, it can be determined, for example, whether or not any adjustment in the apparatus is required from time to time. In the past, the position indicators have suffered from a number of disadvantages. Not only were they relatively complicated, which in turn made them expensive and difficult to service or repair, but they were also inadequate in terms of the accuracy with which they would determine the relative positions of the compensator bodies, and thus, the connected well and support structures.

SUMMARY OF THE INVENTION

The present invention contemplates the incorporation of a relatively simple subsystem into an offshore motion compensation apparatus to serve as the position indicator therefor. This subsystem includes a commercially available apparatus for producing an electrical signal which is a function of hydraulic head. More specifically, it comprises a flexible tube having a liquid reservoir at one end and a pressure sensitive transmitter at the other. The tube is filled with liquid between its two ends. One end is mounted on one of the compensator bodies, while the other, specifically that associated with the transmitter, is mounted on the other body generally below the reservoir end. As the compensator bodies move vertically relative to each other, the distance between the two ends of the flexible tube changes, thus varying the hydraulic head at the lower end, and therefore, the magnitude of the signal produced by the transmitter. The latter electrical signal can be translated into a visual readout by well known means.

Because of the simplicity of the position indicator subsystem, it is relatively inexpensive and easy to repair in situ. It is also safe since neither the current required to operate the transmitter, nor its output signal, need be particular strong. Likewise, the liquid which is contained within the flexible tube can be of a harmless nature. Another significant advantage is that this particular type of position indicator can be relatively easily incorporated into virtually any type of motion compensator without substantial redesigning of the latter. Nevertheless, with all its simplicity and the consequent advantages, the position indicator is much more accurate than those typical of the prior art. For example, if the maximum distance between the two ends of the tube is 20 feet, the degree of accuracy may be as high as $\pm 0.5$ in.

Accordingly, it is a principal object of the present invention to provide an offshore motion compensator with improved position indicator means.

Another object of the present invention is to provide such a motion compensator in which the position indicator means includes apparatus for inherently creating and measuring a hydraulic head and producing a signal which is a function thereof.

Still another object of the invention is to provide such a motion compensator in which the position indicator means is relatively simple and inexpensive, yet safe, versatile, and highly accurate.

Still other objects, features, and advantages of the present invention will be made apparent by the following detailed description of preferred embodiments, the drawings, and the claims.

DETAILED DESCRIPTION OF THE DRAWINGS

Figure 1:
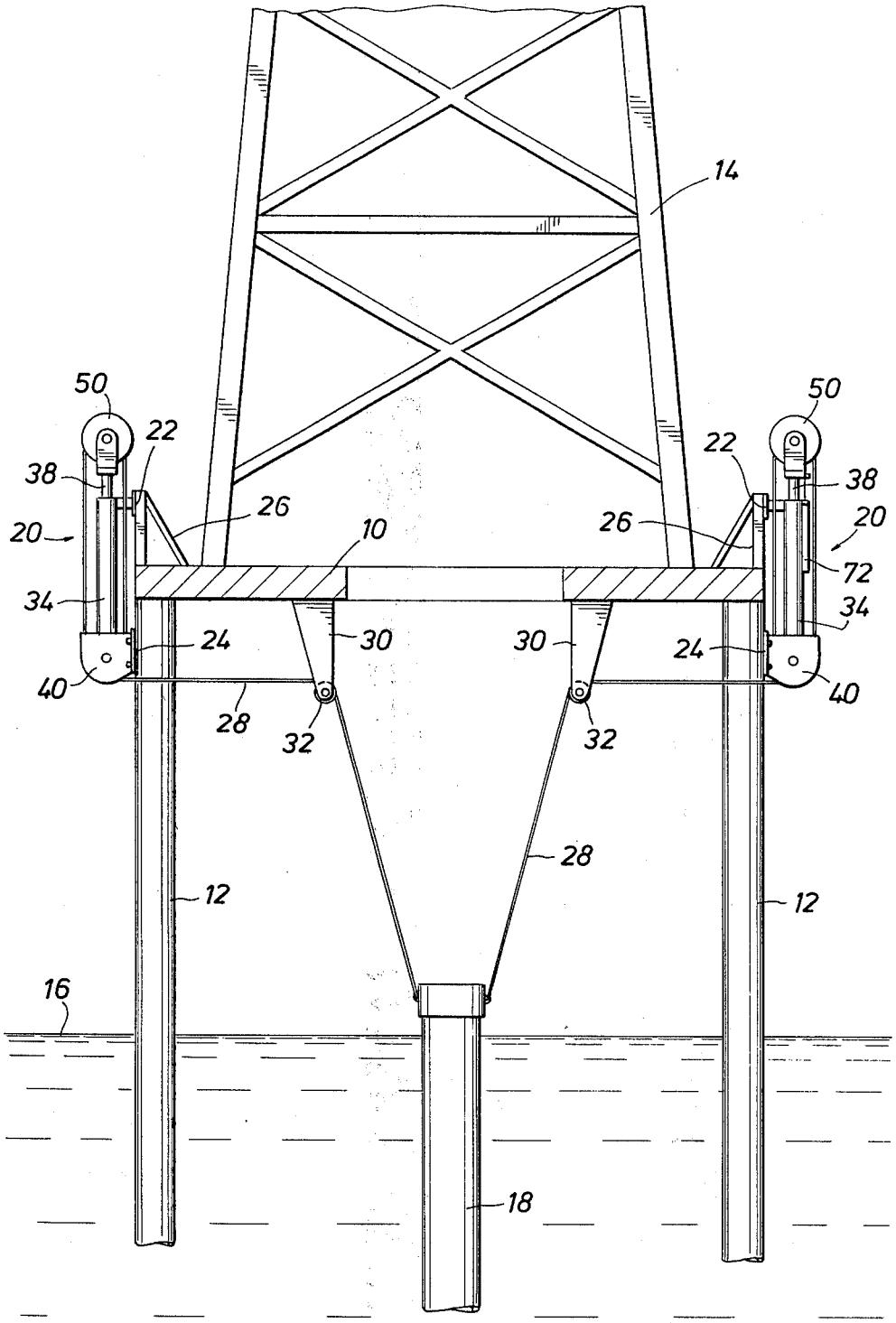
FIG. 1 is a diagrammatic vertical elevational view of an offshore support and riser pipe with associated riser tensioners incorporating the present invention.

FIG. 1 illustrates, in simplified and diagrammatic form, an offshore floating drill rig 10. Rig 10 has legs 12 which support the structure on pontoons (not shown) in the body of water 16. A derrick 14 is supported on the deck of rig 10. Below rig 10, there is shown the upper end of a string of riser pipe 18 which extends downwardly to a subsurface well.

Because the riser pipe 18 is necessarily flexible, and is upstanding in the body of water 16, it will move about relative to rig 10. More importantly, the rig itself will heave and sway as it floats on the body of water 16.

In order to compensate for such relative motion, a pair of opposed motion compensators in the form of drill string tensioners 20 are provided. Of course, while two of the tensioners 20 are shown in FIG. 1, any number may be used. Each of the tensioners 20 is connected to rig 10. More specifically, each tensioner comprises upper and lower mounting pads 22 and 24. The lower pad 24 may be screwed or otherwise rigidly affixed to a respective one of the legs 12, while the upper pad 22 is connected by a support bracket 26 to the deck of the rig 10. Each tensioner 20 is further connected to the upper end of the riser pipe 18 by a respective flexible cable 28. A pair of brackets 30 depend downwardly from the underside of the deck of rig 10, and each bracket 30 carries a pulley 32. Each of the cables 28 has one end attached to the upper end of riser pipe 18, is reeved over a respective one of the pulleys 32, and extends thence to the lower end of the respective tensioner 20.

Figure 2:
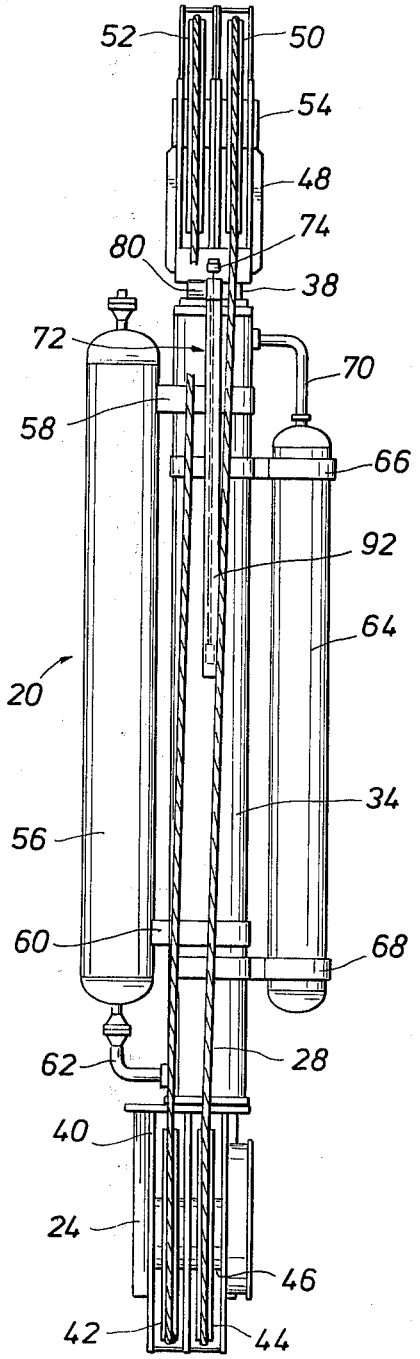
FIG. 2 is a enlarged elevational view of one of the riser tensioners of FIG. 1.
Figure 3:
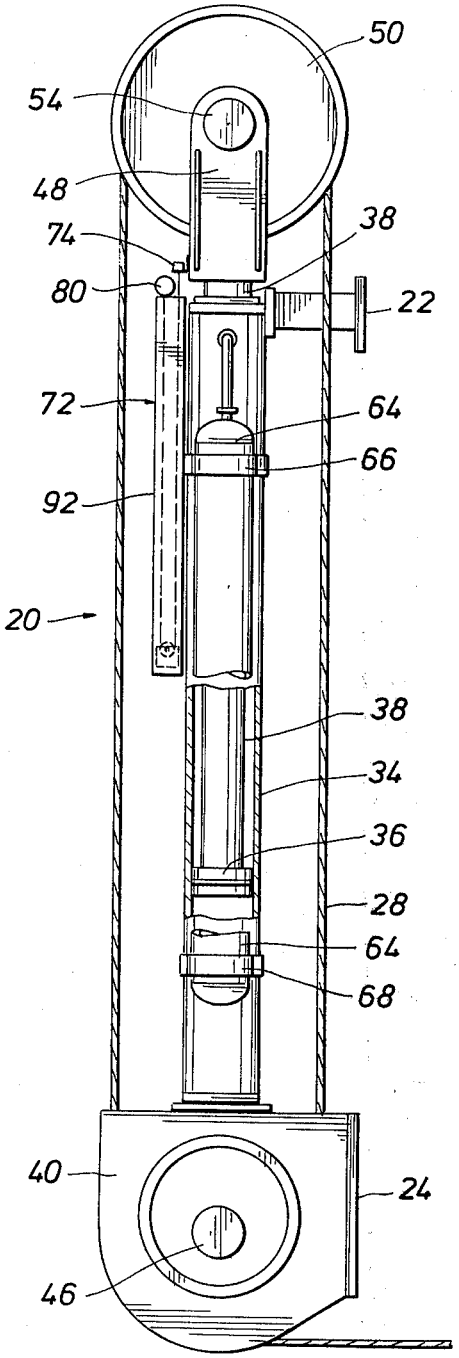
FIG. 3 is a view taken at right angles to FIG. 2.

Referring now to FIGS. 2 and 3, an exemplery tensioner 20 is shown in greater detail. However, it should be understood that the position indicator subsystem can be applied to numerous types of tensioners. Tensioner 20 includes a first compensator body in the form of a cylinder 34 arranged generally vertically. As used herein, the expression "generally vertically" and like expressions will be used to means that the longitudinal centerline of the item in question is oriented such that it has at least a substantial vertical component of direction. A second compensator body in the form of a piston 36 is disposed within cylinder 34, and the attached piston rod 38 extends upwardly and out through the upper end of cylinder 34. The upper end of cylinder 34 is sealed with respect to piston rod 38 by conventional means (not shown). A sheave assembly, comprising a mounting bracket 40 and sheave wheels 42 and 44, rotatably mounted on bracket 40 by a shaft 46, is rigidly affixed to the lower end of cylinder 34. Mounting pad 24, described above, is rigidly affixed to bracket 40. A somewhat similar sheave assembly, including a mounting bracket 48 and sheave wheels 50 and 52, rotatably mounted on bracket 48 by a shaft 54, is affixed to the upper end of piston rod 38.

Cable 28 is reeved under sheave wheel 42, over sheave wheel 52, back downwardly and under sheave wheel 44, back upwardly and over sheave wheel 50, and finally, is extended back downwardly and its end secured to bracket 40, and thus, to cylinder 34. Thus, while the cylinder 34 is rigidly affixed to support rig 10 as described above, the riser pipe 18 is effectively partially supported on piston 36 and its piston rod 38. Any movement of riser pipe 18 relative to support rig 10 will cause or tend to cause a corresponding movement of piston rod 38 and piston 36 relative to cylinder 34. Therefore, for purposes of the present discussion, it can be said that piston 36 and piston rod 38 are effectively connected to riser pipe 18, even though the points of contact of sheave assembly 48, 50, 52 with the interconnecting cable 28 will vary.

In order to yieldingly support piston 36 within cylinder 34, and thereby resiliently resist relative movement of the piston and cylinder in a first directional mode, namely downward movement of the piston and/or upward movement of the cylinder, a compressible fluid, preferrably a compressed gas, is disposed in the lower portion of cylinder 34 below piston 36. Such pressurized gas is supplied from a tank 56 mounted on cylinder 34 by brackets 58 and 60 and communicating with the lower end of cylinder 34 by means of a conduit 62. By adjusting the pressure of the gas within tank 56 and the lower portion of cylinder 34, tensioner 20 can be adjusted to provide a desired amount of resistance to relative movement of piston 36 and cylinder 34 in the aforementioned first directional mode, and therefore, to relative movement of riser pipe 18 and support rig 10. At the same time, because the gas is compressible, and the resistance to movement is therefore resilient, such movement is permitted when the forces reach a certain magnitude; this prevents breakage of cable 28 or other damage or mishap. Thus, it might be said that the effect of tensioner 20 is to maintain the tension in cable 28 within given limits. Referring again to FIG. 1, it can be seen that the two tensioners 20 are opposed and tend to resist lateral movement of riser pipe 18 in opposite directions. Accordingly, the two tensioners 20, working together, keep the riser pipe 18 generally centered with respect to the support rig 10 as well as the well therebelow.

As a safeguard against excessively rapid movement of piston 36, particularly in the event of an accident such as breakage of one of the fluid lines or some other part of the apparatus, a low pressure fluid may be supplied to the rod end of cylinder 34, in a manner well known in the art. Briefly, this fluid may be a liquid, such as oil, urged into the cylinder by a slightly pressurized gas, such as air. A tank 64, mounted on cylinder 34 by brackets 66 and 68, and communicating with the rod end of cylinder 34 by a conduit 70, contains the pressurized air and the oil and provides for overflow of oil when the piston 36 moves upwardly within its cylinder 34.

In operation, it is desirable for the operator to be able to determine the position of piston 36 within cylinder 34. To this end, in accord with the present invention, the tensioner 20 is provided with an improved position indicator, generally denoted by the numeral 72.

Figure 4:
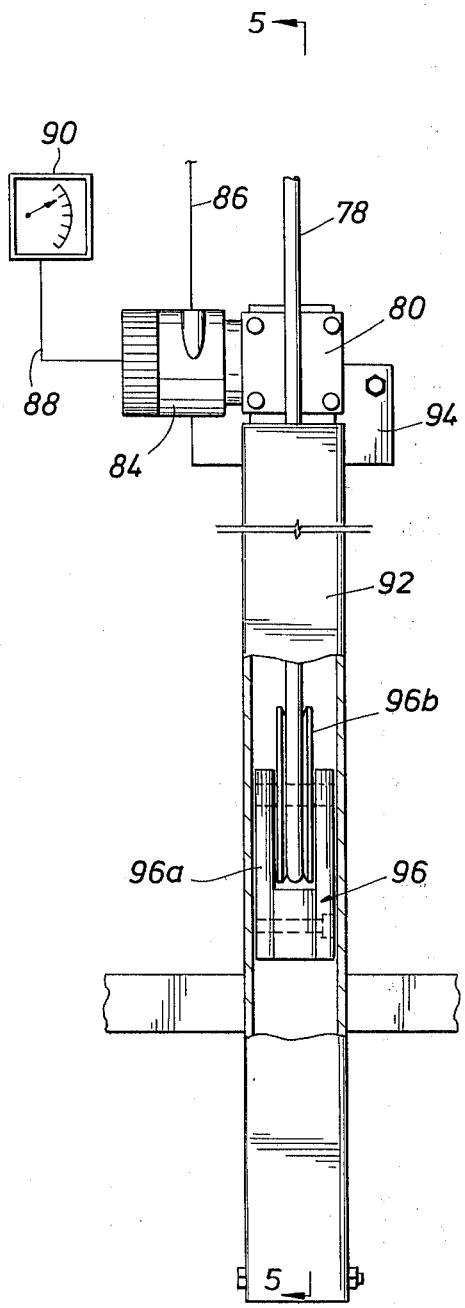
FIG. 4 is a further enlarged vertical elevational view, with parts broken away, of the position indicator subsystem of the tensioner of FIGS. 2 and 3.
Figure 5:
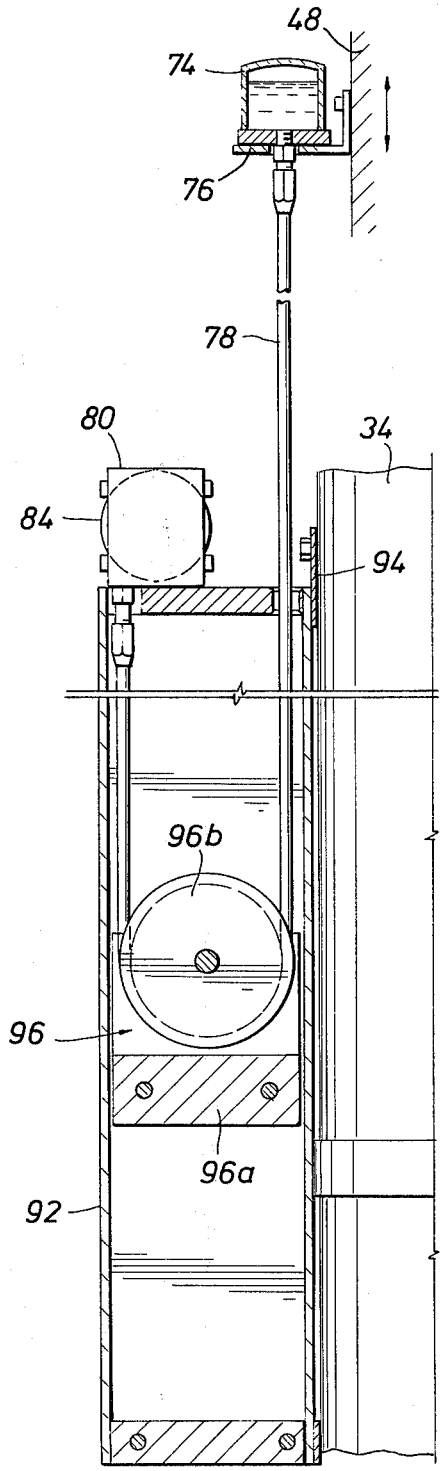
FIG. 5 is a partial-sectional, partial-elevational view taken along the line 5—5 in FIG. 4.

Position indicator 72 is shown in greater detail in FIGS. 4 and 5. The position indicator includes a liquid reservoir 74 mounted by a suitable bracket 76 to the larger bracket 48 which is carried by piston rod 38. One end of a flexible vessel in the form of a flexible tube 78 is communicatively connected, by a suitable fitting, to reservoir 74. Thus, said one end of tube 78 is connected to piston 36 by means of members 74, 76, 48 and 38. The other end of tube 78 is communicatively connected to one half of a chamber 80, which is divided by a diaphragm (not shown). The portion of the chamber on the opposite side of diaphragm 82 is operatively associated with a transmitter 84. The sub-assembly 80, 84 is of a type commercially available, e.g. from Fisher & Porter under the name "Electronic Differential Pressure Transmitter—Type 50DPF 100". Thus, its structure and operation will not be described in detail herein. Briefly, electrical power is supplied to transmitter 84 by a line diagrammatically indicated at 86. The unit 80 senses the pressure exerted on the diaphragm therein, and thus the hydraulic head at or near the adjacent end of tube 78, and transmitter 84 translates this variable pressure into a corresponding electrical signal which is a function of that pressure. The electrical signal is conveyed by a line diagrammatically indicated at 88 to a suitable readout device, such as the gauge 90, which can be located at any convenient site on the support platform 10 for observation by an operator. Both reservoir 74 and chamber 80 are provided with suitable vents (not shown).

Unit 80, 84 is mounted on the upper end of a housing 92 which in turn is connected to cylinder 34 in a position such that, given the normal limitations on the travel of piston 36, unit 80, 84 and the attached end of tube 78 will always be lower than the other end of tube 78 and the attached reservoir 74. However, since the upper end of tube 78 is connected to piston rod 38, while the lower end is connected to cylinder 34, relative movement between the piston and cylinder will vary the vertical distance between the two ends of tube 78, and thus, the hydraulic head at the lower end of the tube. Accordingly, the pressure sensed by unit 80 and the signal produced by transmitter 84 will vary as a function of the distance between the piston 36 and cylinder 34.

In order to take up slack in tube 78, it is reeved over a traveling block assembly 96, including sheave wheel **96*b* and bracket 96*a* slidably disposed within housing 92. This expedient also retains a substantial portion of tube 78 within housing 92, where it is further protected from damage, entanglement, etc. The liquid within the reservoir 74, which in turn fills the tube 78, can be of a relatively harmless nature, such as ethylene glycol. Thus, if the tube 78 should break or become detached, no harm results. Furthermore, any such mishap can be easily and inexpensively repaired. Nevertheless, the degree of accuracy of the position indicator is extremely high, particularly as compared with prior art devices. For example, if the upper limit of the range of distances between the two ends of tube 78 is 20 feet, the readout at gauge 90** might be as accurate as about ±0.5 in.

Figure 6:
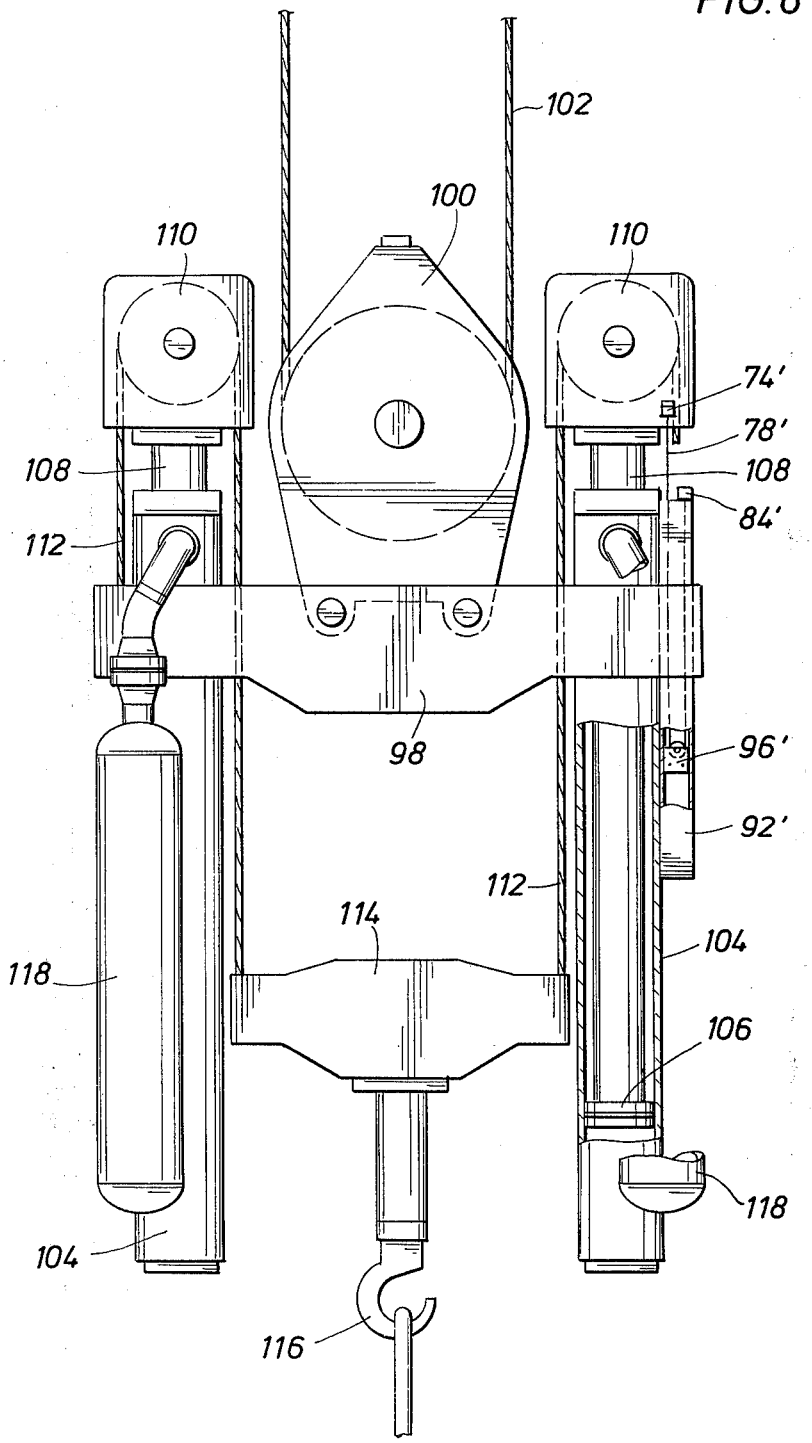
FIG. 6 is a vertical elevational view of a drill string compensator incorporating a position indicator according to the present invention.

Referring now to FIG. 6, the invention is shown as applied to a different type of motion compensator, namely a drill string compensator. For further details of the structure, environment, and operation of such compensators, reference may be had to U.S. Pat. Nos. 3,877,680 and 3,804,183. Briefly, the compensator includes a frame 98 which is suspended by a traveling block 100 and tackle 102 from an offshore support structure, such as a derrick carried by a drilling vessel, semi-submersible or the like. Rigidly affixed to the frame 98 are a pair of parallel cylinders 104, each of which contains a piston, one of which is shown at 106. The piston rods 108 extend outwardly from the upper ends of cylinders 104 and carry respective sheave assemblies 110. For each piston and cylinder assembly, there is a cable 112. Each cable 112 has one end fixed to frame 98 and extends upwardly therefrom over the sheave wheel of a respective one of the assemblies 110, and then downwardly, its other end being attached to a cross-piece 114, movable relative to frame 98. Cross-piece 114 carries a hook 116 from which the drill string is ultimately suspended.

Accordingly, it can be seen that the frame 98 and the attached cylinders 104 are connected to the support structure, while the drill string is effectively supported by pistons 106, and thus for present purposes, can be said to be connected to those pistons. As in the case of the riser tensioner described above, the blind or lower end of the cylinder 104 is supplied with compressed air for resiliently supporting piston 106, and thereby resisting relative movement of the piston and cylinder in a mode which includes downward movement of the piston or upward movement of the cylinder. Likewise, as a safety precaution, the upper or rod end of each cylinder 104 may contain a low pressure fluid, which can spill over into vessels 118 upon upward movement of piston 106.

The position indicator sub-assembly may be associated with either one, or if desired, both of the piston and cylinder assemblies 104, 106. The position indicator is substantially identical to that illustrated in FIGS. 4 and 5. Briefly, it includes a housing 92' rigidly affixed to cylinder 104 and carrying at its upper end a pressure sensor transmitter, diagrammatically indicated at 84'. A liquid reservoir 74' is carried by sheave assembly 110 for movement with piston 106 and piston rod 108. Reservoir 74' and unit 84' are interconnected by a flexible tube 78'. The mid portion of tube 78' extends downwardly into housing 92' where it is reeved over a traveling block assembly 96'. As in the preceding embodiment, as the difference between the two ends of tube 78' varies due to relative movement of piston 106 and cylinder 104, the change in hydraulic head at the lower end of tube 78 is translated by unit 84' into an electrical signal which is transmitted, by a line (not shown) to a suitable readout device.

We claim:

1. Motion compensation apparatus for disposition between an offshore support structure and an offshore well structure movable with respect to said support structure, comprising:

first and second compensator bodies interconnected with said support structure and said well structure such that relative movement between said structures causes relative movement between said compensator bodies, said bodies further being interconnected with each other for relative movement in generally vertical directional modes;

means associated with said compensator bodies for resiliently resisting relative movement therebetween in a first directional mode;

and position indicator means associated with said bodies comprising— a flexible vessel having one end connected to said one of said compensator bodies and the other end connected to the other of said compensator bodies generally below said one end, said vessel being filled with a liquid between said ends;

and pressure sensitive transmitter means associated with said other end of said vessel and operative to produce a signal which is a function of the hydraulic head at said other end of said vessel.

2. The apparatus of claim 1 wherein said signal is electrical, said apparatus further comprising power supply means operatively connected to said transmitter means.

3. The apparatus of claim 2 further comprising in readout means operably connected to said transmitter means for producing a readout variable with said signal.

4. The apparatus of claim 1 wherein said vessel is a flexible elongate tube.

5. The apparatus of claim 4 further comprising a fluid reservoir connected to said one end of said vessel.

6. The apparatus of claim 4 further comprising means for taking up slack in said tube.

7. The apparatus of claim 6 wherein said means for taking up slack in said tube comprises a traveling block with said tube reeved about the sheave wheel of said traveling block.

8. The apparatus of claim 7 further comprising housing means encasing said traveling block and a portion of said tube.

9. The apparatus of claim 8 wherein said housing means is carried by said other of said compensator bodies and said transmitter means is mounted on said housing means.

10. The apparatus of claim 1 wherein said well structure is a drill string.

11. The apparatus of claim 1 wherein said well structure is a string of riser pipe.

12. The apparatus of claim 1 wherein said one compensator body comprises a piston, and said other compensator body comprises a cylinder receiving said piston.

13. The apparatus of claim 12 wherein said means resiliently resisting movement comprises a compressible fluid interposed between said piston and one end of said cylinder.

* * * * *

UNITED STATES PATENT AND TRADEMARK OFFICE

CERTIFICATE OF CORRECTION

PATENT NO. : 4,421,173

DATED : December 20, 1983

INVENTOR(S) : Bruce E. Beakley; Douglas W. J. Nayler

It is certified that error appears in the above—identified patent and that said Letters Patent is hereby corrected as shown below:

In Column 6, line 33, delete "said".

Signed and Sealed this

*Nineteenth* Day of *March 1985*

[SEAL]

*Attest:*

DONALD J. QUIGG

*Attesting Officer* *Acting Commissioner of Patents and Trademarks*